US005218327A

United States Patent [19]

Calabrese

[11] Patent Number: 5,218,327

[45] Date of Patent: Jun. 8, 1993

[54] VARIABLE/SWITCHABLE COUPLER

[75] Inventor: Matt Calabrese, Huntington Beach, Calif.

[73] Assignee: Hughes Aircraft Company, Los Angeles, Calif.

[21] Appl. No.: 675,781

[22] Filed: Mar. 27, 1991

[51] Int. Cl.[5] ..... H01P 5/18

[52] U.S. Cl. ..... 333/111; 333/113

[58] Field of Search ..... 333/103, 111, 113, 157, 333/164, 81 B, 258, 250

[56] References Cited

U.S. PATENT DOCUMENTS

| | | | |
|---|---|---|---|
| 3,016,495 | 1/1962 | Tien | 333/113 X |
| 3,017,585 | 1/1962 | Luke | 333/103 |
| 3,801,932 | 4/1974 | Coldie | 333/157 |
| 3,979,703 | 9/1976 | Craven | 333/258 |
| 4,571,559 | 2/1986 | Henry et al. | 333/250 X |
| 4,754,243 | 6/1988 | Armstrong et al. | 333/250 |

*Primary Examiner*—Paul Gensler

*Attorney, Agent, or Firm*—Leonard A. Alkov; Wanda Denson-Low

[57] ABSTRACT

A waveguide coupler wherein the coupling of power from one waveguide arm to an adjacent waveguide arm through an aperture in a common wall may be switched on and off at very high speed or controlled from zero to a maximum level by appropriately controlling how bias potential is applied to a reflective/absorptive element disposed in the aperture in the common wall.

7 Claims, 2 Drawing Sheets

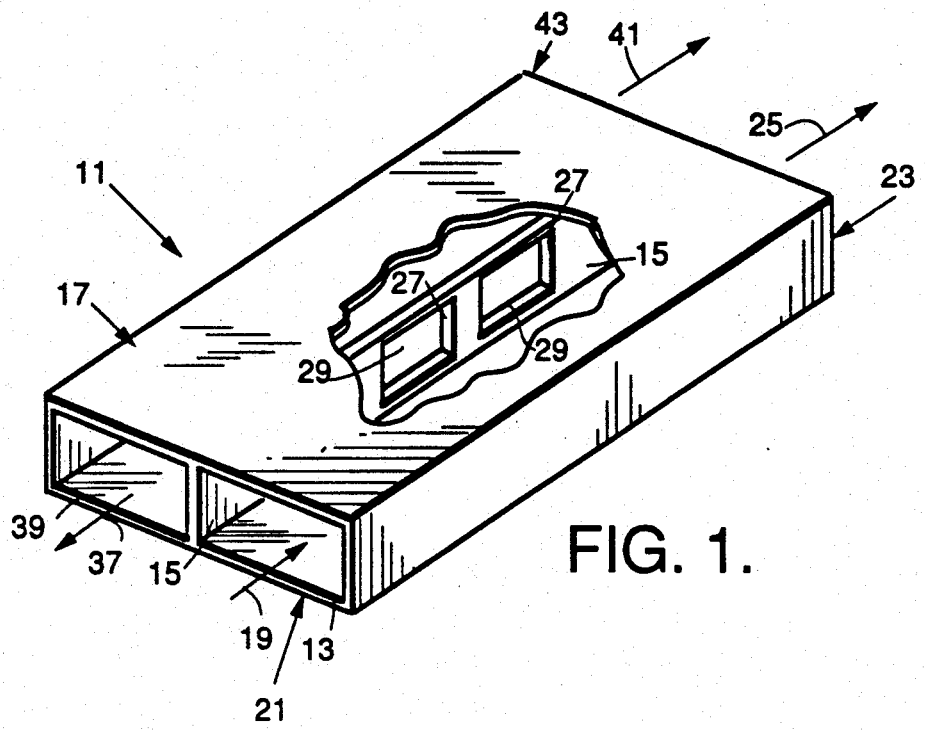
FIG. 1.
FIG. 2.
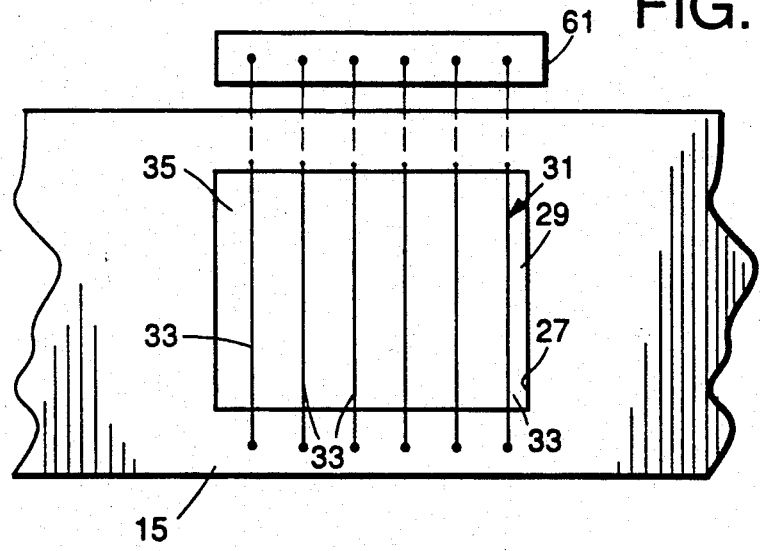
FIG. 3.
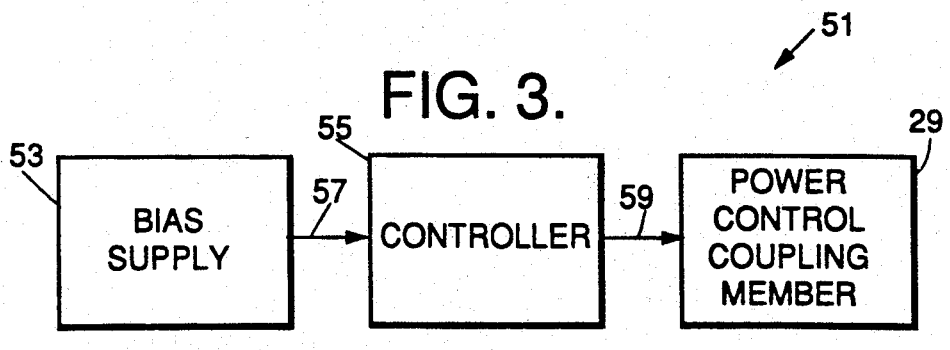

VARIABLE/SWITCHABLE COUPLER

BACKGROUND

The present invention relates generally to microwave couplers, and more particularly, to a waveguide coupler having two waveguide arms with one or more coupling apertures in a common wall, and wherein the amount of power coupled from one arm to the other may be adjusted from zero to a maximum level.

High power waveguide switches currently available have shutters that close or open an aperture that is common to joining waveguides. Some of these devices utilize a rotating drum having appropriately disposed ports, while others use an electromechanically rotated vane or door member. The disadvantages of these types of switches are that they are slow in acting, heavy, and require a considerable amount of power to operate the switch actuator. Also, they do not allow for the varying of the power output level to be transferred from one port to another. In other words, these types of switches can only act as on/off switches.

The trend in the microwave art, and more particularly to the radar art, is to fabricate light weight mobile and transportable systems, including light weight antenna arrays. The present invention allows this goal to be accomplished by eliminating a heavy solenoid switch, and the like. As a further benefit, electrically the invention offers the ability, for example, to vary the power to a null horn, for performance optimization. Although described for certain uses above, it should be understood that this invention is not limited to radar applications and military applications, but, also has potential for widespread commercial applications.

SUMMARY OF THE INVENTION

The variable/switchable coupler in accordance with the present invention is a four port device consisting of primary and secondary arms which share a common wall, and power is coupled from the primary to secondary arms via one or more apertures. The power coupled to the secondary arm from the primary arm can be varied up to a maximum level or completely eliminated.

The advantages of this variable/switchable coupler are to allow fast switching and/or varying power into the secondary arm. That is, the switching aspect allows a desired amount of power or prevents all the power from entering the secondary arm at electronic switchable speeds. That is, the varying aspect of the invention allows partial power to enter the secondary arm at a level controlled electronically by the user.

In view of the foregoing, it is a primary object of the present invention to provide a new and improved variable/switchable coupler.

Another object of the present invention is to provide a simple yet reliable and efficient variable/switchable coupler.

Still another object of the present invention is to provide a variable/switchable coupler capable of being easily controlled whereby output power may be varied between zero and a maximum amount.

Yet another object of the present invention is to provide a transmission line switch that is easily incorporated into an rf feed system, which switch weighs less than prior art switches used for a similar purpose.

In accordance with one embodiment of the present invention, a variable/switchable coupler is provided having a waveguide structure with a primary arm and a secondary arm sharing a common narrow wall. The invention also includes coupling means including at least one aperture in the common wall, and reflective/absorptive means disposed in the aperture(s) for controlling the amount of power entering the secondary arm from the primary arm through the aperture(s).

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 1 is a perspective view of a variable/switchable coupler in accordance with the present invention;

FIG. 2 is an enlarged view of the absorptive/reflective array disposed in an aperture in a common wall of the coupler;

FIG. 3 is a block diagram of bias control arrangement for use with the invention of FIG. 1.

DETAILED DESCRIPTION

Figure 4:
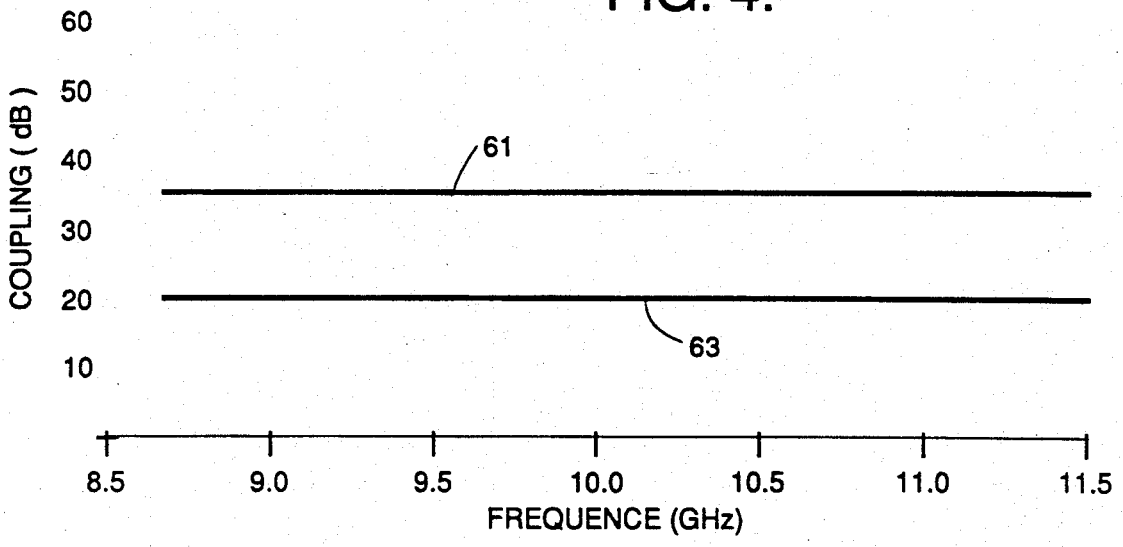
FIGS. 4 and 5 are graphs illustrating that the absorptive/reflective array of the invention has a pronounced effect on the isolation and coupling of the inventive coupler over a broad frequency range.

The variable/switchable 11 coupler of the invention consists of a first waveguide section 13 joined at the common narrow wall 15 to a second waveguide section 17 as shown in FIG. 1. Input power 19 is conventionally coupled to an input port or first port 21 of the first waveguide section 13, and if no power is coupled out of this waveguide section prior to reaching a second port 23 at the opposite end of the waveguide 13, the first waveguide section output power 25 will essentially be the same as the input power 21.

The narrow wall 15 is provided with apertures 27 that accommodate a power control coupling member 29 of reflective/absorptive material. In this embodiment, the member 29 includes an array 31 of pin diodes 33 (represented simply by lines in FIG. 2), disposed on a silica substrate 35. By controlling the amount of power coupled through the apertures 27, the amount of power 37 exiting a third port 39 and power 41 exiting an opposite fourth port 43 of the second waveguide section 17 may be controlled.

As is well known in the waveguide art, with proper termination of the third port 39, power 19 entering the first port 21 can be made to couple to the second waveguide section 17 and exit from the fourth port 43 at a maximum level set by the size of the apertures 27. By properly applying bias potential to selected diodes mounted on the reflective/absorptive material, the coupler 11 output power 41 can be switched at high speeds from zero to any desired power level up to the maximum level, or varied more slowly in any desired range from zero to the aforementioned maximum level.

The application of bias potential to selected diodes (represented in FIG. 2 by wires 33) may be implemented by a non-unique bias power-controlling circuit 51 shown in FIG. 3, for example. Here, a conventional bias potential supply 53 is coupled to a conventional controller circuit 55 through a cable 57 which is, in turn, coupled by a cable 59 to a bias header 61 (FIG. 2) of the power control coupling member 29.

In operation, the bias supply 53 provides a potential sufficient to either place diodes 33 in a conductive or non-conductive state. In a conductive state, each pin diode would act as a vertical wire extending across the aperture 27, in this case the aperture is a 0.300 inch square configuration. It should be now evident that a controller circuit, such as the controller 55, is a conventional circuit which can increase and decrease the number of such diodes that are biased to a point of conduction. Thus, this controller controls the amount of energy that can couple through the aperture 27 from the first waveguide section 13 to the second waveguide section 17.

Figure 5:
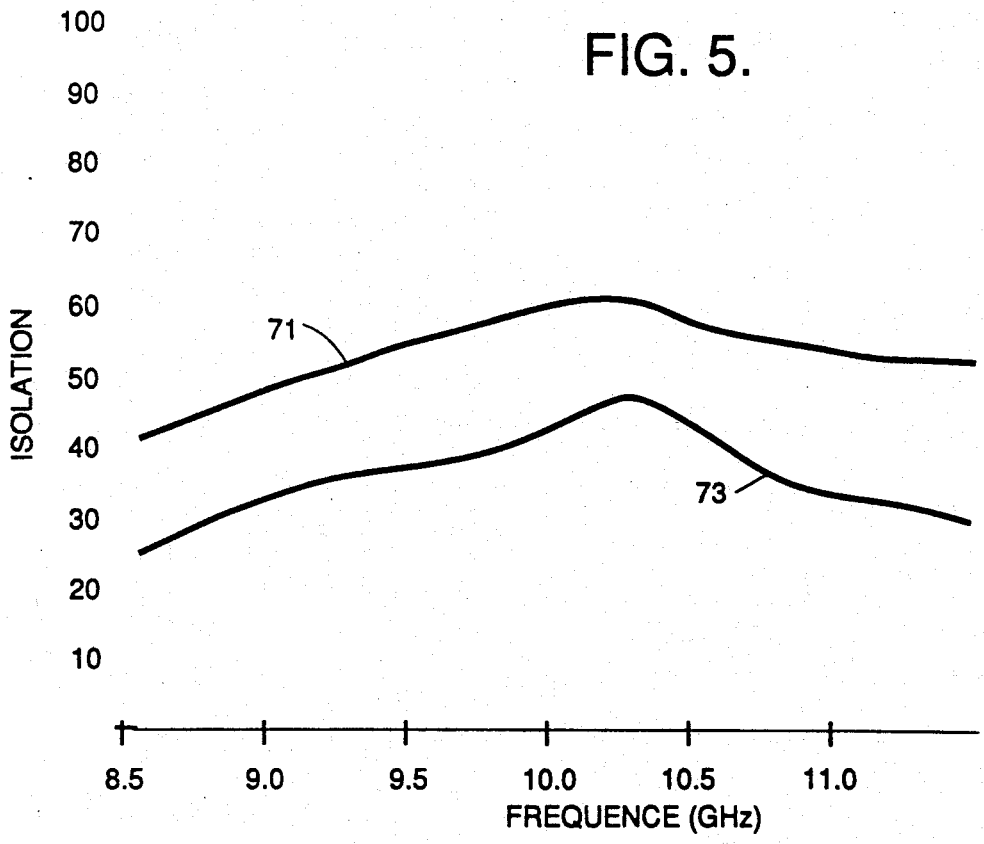

Tests that support this concept are graphed in FIGS. 4 and 5. In FIG. 4, there is shown a graph of coupling, in dB, compared over a frequency range from approximately 8.5 GHz to 11.5 GHz. The line 62 shows the coupling with vertical wires in the common wall aperture, and line 63 indicates the amount of coupling when no wires are disposed in this aperture. As to FIG. 5, there is illustrated the isolation over the above frequency range, where line 71 follows the isolation with vertical wires in the aperture, and line 73 shows the isolation without such wires.

The graph demonstrates that when the reflective/absorptive material (with its pin diodes acting as wires) is mounted in a 0.300 inch square aperture, the vertical wires (diodes 33) have a pronounced effect on the isolation and coupling. From this representation, it should be obvious that by electrically varying the number of vertical wires electrically present in the aperture, the coupling level may be accordingly varied from zero up to the maximum possible as limited by the dimensions of the aperture. Again, the power controlling member 29 of reflective/absorptive material can be made to accomplish the control of coupled power by biasing it properly.

Thus, there has been described a new and improved, light weight, variable/switchable waveguide coupler capable of switching rf power at high speeds in any power range from zero to a maximum value. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A variable/switchable coupler including a waveguide structure having a primary arm and a secondary arm sharing a common narrow wall, comprising:

coupling means including at least one aperture in said common wall, and reflective/absorptive diode means disposed in said aperture for variably controlling the amount of power entering said secondary arm from said primary arm through said aperture, wherein the power coupled to the secondary arm from the primary arm is controllably variable from a minimum level to a maximum level.

2. The variable/switchable coupler according to claim 1, wherein said reflective/absorptive means includes a pin diode array disposed on a substrate.

3. The variable/switchable coupler according to claim 2, wherein said substrate is silica.

4. The variable/switchable coupler according to claim 2, wherein said pin diodes are parallel.

5. The variable/switchable coupler according to claim 2, wherein said pin diodes are vertically oriented.

6. The variable/switchable coupler according to claim 2, wherein said coupling means also includes bias potential means for providing bias potential to said diodes in said pin diode array.

7. The variable/switchable coupler according to claim 6, wherein said bias potential means includes a bias potential supply and power level means for selecting the number of the pin diodes in said diode array to which bias potential is applied.

* * * * *